US007695215B2

(12) United States Patent
Buhr et al.

(10) Patent No.: US 7,695,215 B2
(45) Date of Patent: Apr. 13, 2010

(54) METHOD AND SYSTEM FOR BROADCAST SEDIMENT CAPPING

(75) Inventors: Victor Joseph Buhr, Holmen, WI (US); Greg Smith, Emmetsburg, IA (US); Dennis Rosendale, West Salem, WI (US); Tyler Lee, Hokah, MN (US); Kevin Zenke, Dakota, MN (US)

(73) Assignee: J.F. Brennan Co., Inc., La Crosse, WI (US)

( * ) Notice: Subject to any disclaimer, the term of this patent is extended or adjusted under 35 U.S.C. 154(b) by 145 days.

(21) Appl. No.: 12/134,924

(22) Filed: Jun. 6, 2008

(65) Prior Publication Data

US 2009/0304447 A1 Dec. 10, 2009

(51) Int. Cl.
*E02D 15/10* (2006.01)

(52) U.S. Cl. ..... 405/17; 405/222; 405/303

(58) Field of Classification Search ..... 405/15, 405/16, 17, 18, 19, 222, 223, 303
See application file for complete search history.

(56) References Cited

U.S. PATENT DOCUMENTS

| | | | | |
|---|---|---|---|---|
| 4,352,590 | A | 10/1982 | Parker et al. | |
| 4,397,587 | A * | 8/1983 | Op den Velde et al. | 405/222 |
| 4,407,606 | A * | 10/1983 | Larsen | 405/17 |
| 5,150,986 | A | 9/1992 | Rohr | |
| 5,222,839 | A * | 6/1993 | Ishida et al. | 405/303 |
| 5,775,836 | A | 7/1998 | Americo | |
| 6,343,559 | B1 * | 2/2002 | Thomas | 405/34 |
| 6,386,796 | B1 | 5/2002 | Hull | |
| 6,637,135 | B2 * | 10/2003 | Chesner et al. | 405/63 |
| 6,640,470 | B2 * | 11/2003 | Chesner et al. | 405/204 |
| 6,817,119 | B2 | 11/2004 | Kerfoot | |
| 7,011,749 | B2 * | 3/2006 | Hayes et al. | 37/307 |
| 7,025,553 | B1 * | 4/2006 | Thomas et al. | 37/338 |
| 7,115,203 | B2 * | 10/2006 | Hayes et al. | 37/195 |
| 2002/0124440 | A1 * | 9/2002 | Chesner et al. | 37/317 |
| 2002/0133983 | A1 * | 9/2002 | Chesner et al. | 37/307 |
| 2006/0051162 | A1 | 3/2006 | Chesner et al. | |

OTHER PUBLICATIONS

Palermo, Michael, Dredging Research and Placement Techniques for Capping, Jun. 1992, DRP-5-05, http://www.hsrc.org/capping/equip-note.html.

Reible, Danny, Hazardous Substance Research Centers Sout & Southwest, In Situ Sediment Remediation Through Capping: Status and Research Needs, Feb. 2005, http://www.hsrc-ssw.org//pdf/cap-bkgd.pdf.

* cited by examiner

*Primary Examiner*—Frederick L Lagman
(74) *Attorney, Agent, or Firm*—Whyte Hirschboeck Dudek SC

(57) ABSTRACT

Sub-aquatic sediment is covered with capping material by a capping system comprising a template barge and a spreader barge. While the spreader barge is distributing capping material, the template barge guides the spreader barge as it systematically moves over a pre-defined sediment capping region. The spreader barge comprises a spreader pool in which a broadcast spreader accurately and evenly distributes capping material within the pool, which then sinks to the sediment. The capping material is distributed with minimal disturbance to the sediment.

20 Claims, 9 Drawing Sheets

METHOD AND SYSTEM FOR BROADCAST SEDIMENT CAPPING

The present invention relates to a sediment capping method and system. In one aspect the present invention relates to an improved broadcast sediment capping method. In another aspect, the invention relates to an improved sub-aquatic contaminated sediment capping system.

BACKGROUND OF THE INVENTION

Sub-aquatic contaminated sediments often represent a harmful and long term source of pollutants to the environment. A variety of approaches, such as dredging, have been used for the treatment of contaminated sediments, but they are expensive and can have limited value. Due to the increased volume of contaminated sediment cleanup projects both in the U.S. and abroad, sediment capping has become an option. In many areas the removal of material from a water body is not cost effective. In-situ capping of contaminated sediment is an efficient alternative that can have an immediate beneficial impact on the environment, as the contaminated sediment is isolated from aquatic organisms. Furthermore, capping contaminated sediments generally creates an anaerobic environment which permits natural degradation processes, which provide an opportunity for destruction and detoxification of harmful contaminants. Sediment capping has been used to contain harmful contaminants, including pesticides, metals, volatile organic compounds (VOCs), semi-volatile organic compounds (SVOCs), and polynuclear aromatic hydrocarbons (PAHs).

The capping of contaminated sediments is designed to prevent the upward migration of residual contaminants and/or to provide a clean subsurface bed of sediment that can be colonized by uncontaminated organisms. Capping alone could be used as a strategy to eliminate the need for dredging or could be used in conjunction with dredging to cover dredged locations with a clean layer of material where target clean-up goals cannot be achieved.

Previous methods of capping contaminated sediments have often involved mechanical equipment using buckets or direct slurry discharge into a water body. The mechanical bucket method often requires dumping large volumes of capping material into the water using a variety of buckets, including a clamshell bucket or dragline bucket. After releasing a bucket load it falls through a water column often as a distinct mass, which usually comes to rest on top of the contaminated material. This method has had some success in deep water producing caps with designed thickness over 12". The water depth allows the capping material to disperse somewhat reducing velocity and concentration as it travels downward through the water. The thick cap design then accommodates the placement inaccuracies inherent in mechanical bucket placement.

The mechanical bucket method poses problems for relatively shallow water depth capping. When the mechanical bucket method is used to install thin layer caps (3" to 12"), especially in shallow water (less than 10'), the results are often problematic. The capping material travels a relatively short distance through the water, thus causing its weight and velocity to displace the soft contaminated sediments. Displacement of the contaminated sediment is adverse to the purpose and goals of sediment capping. Furthermore, bucket placement of capping material leaves uneven mounds, which must then be raked in order to produce the proper thickness. This raking action often disturbs the underlying sediments, thereby causing sediment mixing and re-suspending of both the capping material and the contaminated sediments. The raking step can result in low production rates and capping material waste, and therefore higher production costs. In addition, bucket placement requires deep vessel draft requirements and cannot be employed in relatively shallow operations.

An alternative known capping method involves the open water slurry discharge method. Due to the large volume of water needed to transport the sand or gravel material this method also tends to displace the soft underlying material needing to be capped. Another problem with this method is that it requires sand or gravel slurry to be directly placed in water which raises turbidity levels. It would be advantageous for a sediment capping process to provide delivery of granular material from shallow draft vessels at relatively high rates of production with minimal disturbance of the sub-aquatic sediment.

SUMMARY OF THE INVENTION

In one embodiment, the invention is a sediment capping system having a spreader barge comprising a capping material spreading means and a spreader pool where the spreading means is configured to distribute capping material into the spreader pool. The system also includes a template barge for guiding the spreader barge while the capping material is distributed to a sub-aquatic sediment. The spreader barge and the template barge include a positioning means. The system further includes a capping material providing means, wherein the capping material is received by the intake means and distributed by the spreading means.

In another embodiment, the invention is a sediment capping system comprising a spreader barge for distributing a capping material over contaminated sub-aquatic sediment, a template barge configured to guide the movement of the spreader barge during distribution of the capping material, and a sub-aquatic elevation measuring means. The capping material distribution has limited disturbance of the sediment and the measuring means can acquire real-time elevation data.

In yet another alternative embodiment, the invention is a method for capping sub-aquatic sediment including identification of a sub-aquatic region for distributing a layer of capping material and providing a source of capping material to a capping system. The capping system includes a template barge, a spreader barge, and a broadcast spreader means. The template barge guides the spreader barge along a pre-determined path while capping material is distributed.

DESCRIPTION OF THE PREFERRED EMBODIMENT

Figure 1:
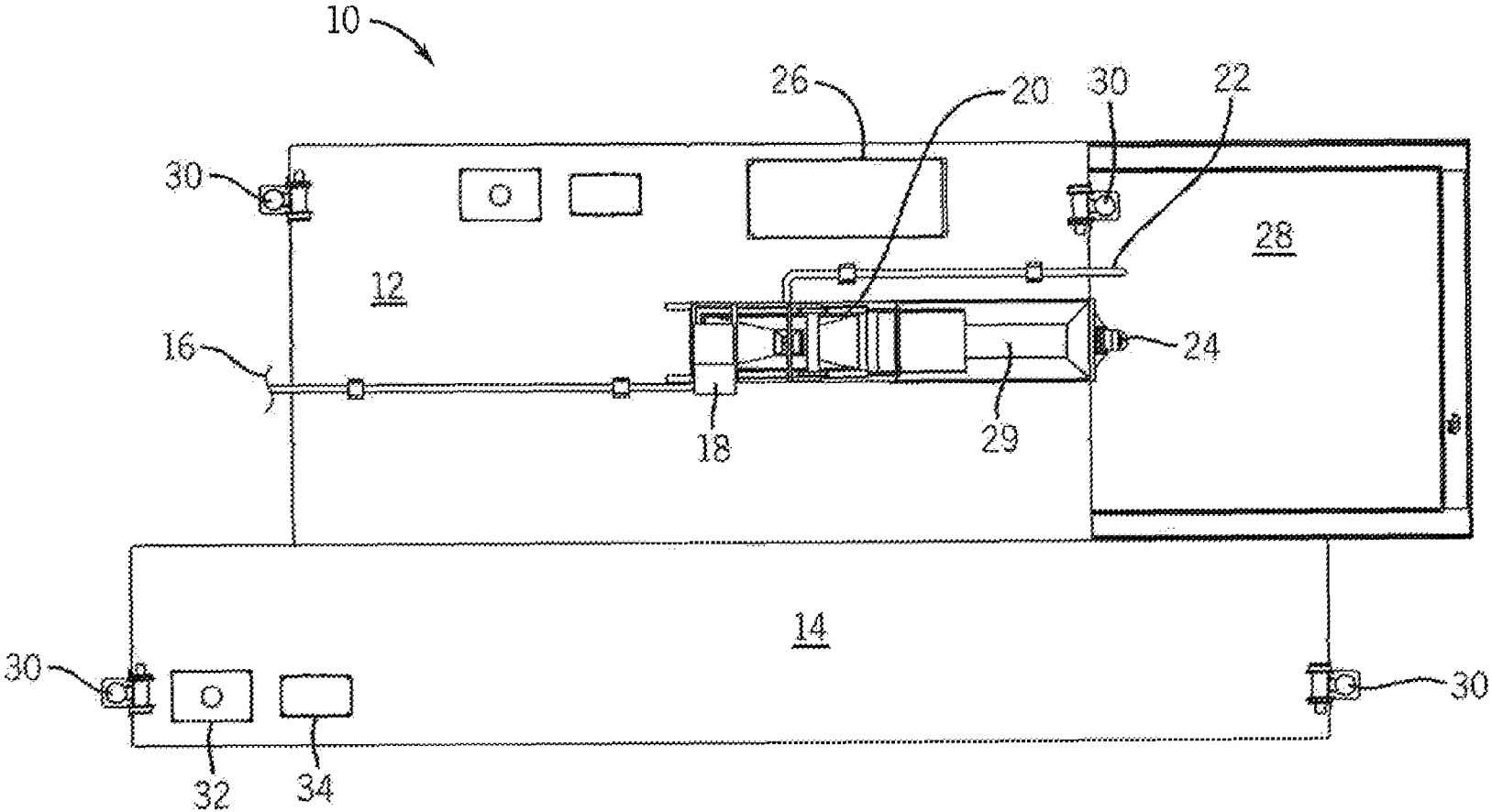
FIG. 1 is a top plan view of a broadcast spreader in accordance with at least one embodiment of the present invention.
Figure 2:
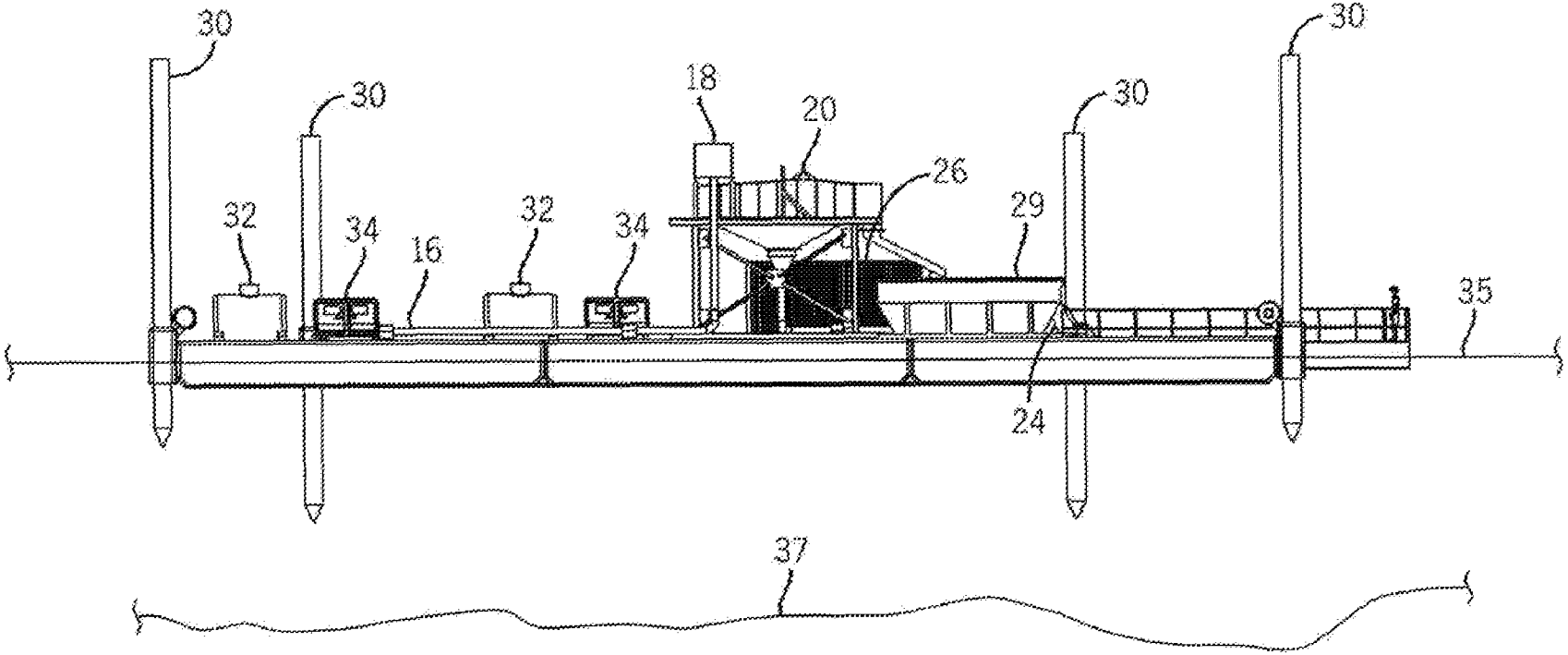
FIG. 2 is a side view of the broadcast spreader according to FIG. 1.

Referring to FIGS. 1 and 2, sediment capping system 10 is provided. System 10 includes spreader barge 12, template barge 14, and capping material providing means 16. Spreader barge 12 includes capping material receiving means 18, capping material shaker 20, slurry water output 22, capping material spreading means 24, control center 26, distribution pool 28, capping material reservoir 29 and at least one positioning means 30. Template barge 14 is releasably engaged with spreader barge 12 while the capping material is being distributed by spreader barge 12. Barge 14 includes at least one positioning means 30, fuel tank 32, and barge movement means 34. Spreader barge 12 and template barge 14 float on waterway surface 35. The slurry enters the spreading barge 12 through the providing means 16 and is received by the receiving means 18, which can be a hopper or alternative structure designed to receive capping material slurry. The shaker 20 separates the capping material from the water contained within the slurry. The water is evacuated through the slurry water output 22 and the capping material is distributed within the pool 28 by the spreading means 24. While the barges 12, 14 are floating on the waterway, the positioning means 30, when deployed, prevents the barges 12, 14 from laterally moving across the waterway. In at least one embodiment of the invention, the slurry water output 22 is a discharge pipe integrally connected to a liquid diffuser. As shown in FIGS. 1 and 2, the positioning means 30 are positioning spuds.

Representative capping materials include but are not limited to sand, gravel, chipped stone, rocks, pebbles, and other solid particulate or granular matter suitable for sediment capping. By example, granular capping materials can range from about 0.1 mm to about 10 mm in size. Stones and rocks used for capping material can range from about ½ inch to about 2 inches. Capping material is transported through pipeline 16, typically in the form of a slurry, and is received by spreader barge 12 at shaker 20. Capping material slurry is the combination of water and solid capping material, which is more easily transported then dry capping material. An exemplary slurry includes a density of about 15% to about 20% by weight capping material. At this exemplary density range a capping material distribution production rate can range from about 60 to about 80 cubic yards per hour. Depending upon the type of capping material, the slurry density can be less than 15% by weight or greater than 20% by weight. Alternatively, the slurry can include granular additives suitable for use in sediment capping. Receiving means 18 can be a hopper or velocity box and is strategically selected based upon the configuration of providing means 16, and the type of capping material used. In an alternative embodiment, providing means 16 can be a variety of capping material transportation means, such as barge transportation, airlift transportation, and extended conveyor transportation. The barge transported capping material can be fed into spreader barge 12 by bucket. This may be desirable when transport distances are excessive, or navigational concerns prevent delivery by slurry pipeline 16.

Capping material shaker 20 processes the slurry by separating the capping material and the water. Water is gravitationally removed through the slurry water output 22, which is a pipeline evacuated into distribution pool 28. The output 22 can also include a water pump for quicker evacuation of the water. The slurry water often contains fine particulate matter. In an effort to avoid contamination of the waterway it is dispensed within distribution pool 28. The distribution pool is a region of the water way confined by the barge 12. Fine capping material pieces remain with the water while the capping material is removed within the shaker 20. As the slurry water is evacuated it enters the pool, the remaining particles gradually sink to the sediment. Since the pool 28 is contained by the barge 12, water currents and surface waves have less effect on the particles, thereby preventing them from dispersing through the water way. Alternatively, the slurry water can be filtered. The capping material is collected within a reservoir 29 and then distributed within the pool 28 by the distribution means 24. Spreading means 24 can be a broadcast spreader and alternatively can be selected from a variety of spreader mechanisms. (See FIGS. 5 and 6). Distribution pool 28 is an open area configured to contain capping material as it is being distributed by the spreading means 24 in order to efficiently and accurately control capping material distribution to sediment layer 37.

Movement of the spreader barge with respect to the template barge is performed by barge movement means 34. Movement means 34 is an engine or winch operated by either a gas or electric fuel source. Engine 34 causes movement of spreader barge 14 with respect to template barge 12. Additionally, when template barge 14 is re-positioned, movement means 34 causes movement of template barge 14 while spreader barge 12 is stationary. Alternatively, movement means 34 comprises a motor operated vehicle, by example, a wheel or caterpillar driven tractor or truck mounted on the template barge. In yet another alternative embodiment, both template barge 14 and spreader barge 12 include a fuel source 32 and movement means 34.

Figure 3:
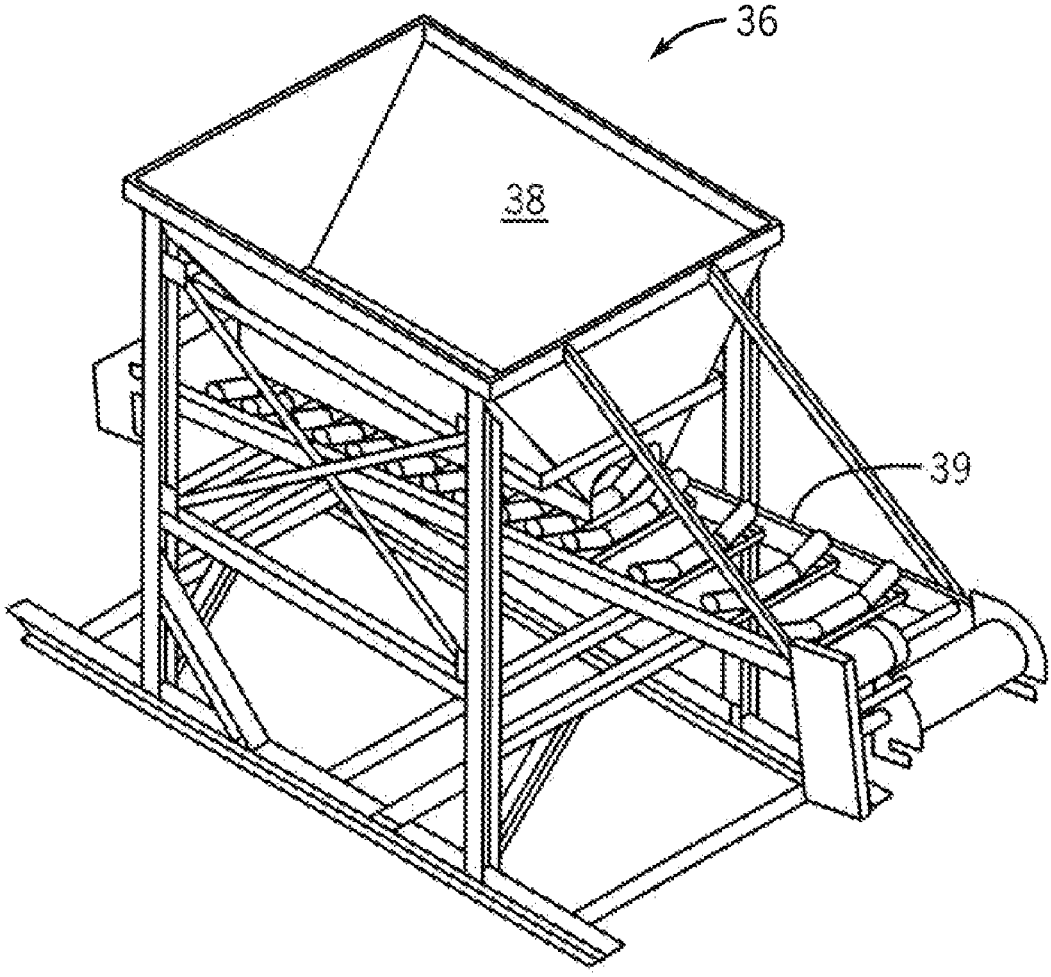
FIG. 3 is a hopper for distributing and metering particulate matter in accordance with at least one embodiment of the present invention.

At least one embodiment of the present invention includes distribution of capping material through slurry pipeline 16. Referring to FIG. 3, capping material conveyor 36 is provided for metering and distribution of capping material to spreader barge 12 through pipeline 16. The conveyor 36 includes a metered hopper 38 into which capping material is loaded and a conveying means 39 configured for metered transportation of capping material to a slurry hopper. The capping material flows from the hopper 38 onto the conveying means 39, which is situated beneath the hopper 38. Loading the capping material into the conveyor 36 can be manual or through an automated conveyor means (not shown). Conveyor 36 then transfers capping material into a slurry hopper (not shown). The slurry hopper is a reservoir that has a water intake, a water overflow, and a slurry pump connected to slurry line 16. The water intake receives water from a water source and combines the water and capping material within the slurry hopper to form a slurry. A combination of the water and dumping of capping material into the hopper from the conveyor 36 provides a mixing action which allows slurry formation. The slurry enters the pipeline 16 and is evacuated through pressure generated by the slurry pump. Excess water is removed through a water overflow pipeline, and is filtered prior to placement back into the waterway. A slurry pump provides a means for forcing the capping material slurry through pipeline 16 to spreader barge 12. The feed rate of the capping material is metered by a feed opening and/or the variable speed of conveyor 36. For the purpose of maintaining material balance, metering at the hopper loading location is important in order to assess the mass rate of delivery to spreader barge 12. Long transport distances may require additional booster pumps (not shown) in order to maintain adequate slurry velocities. By example, slurry velocities for gravel slurry can range from about 10 feet per second (to about 12 feet per second. Gravel slurry velocities less than 10 feet per second and greater than 12 feet per second are contemplated. In at least one embodiment, system 10 is employed within a river having an extended region of contaminated sediment. Within this embodiment slurry pipeline 16 extends in excess of ½ mile. As spreader barge 12 moves farther away from land-based conveyor 36, pipeline 16 is lengthened and booster pumps added to keep the slurry moving to spreader barge 12.

System 10 allows capping material to be deposited evenly over underlying sediments, which can be soft, hard or a mixture of varying densities. One common use of the system is for "capping" contaminated sediments, and it is particularly well suited for shallow water placement of thin layer caps in an efficient manner over large areas with minimal disturbance of the contaminated sediment. Various embodiments of the present invention present a low-cost and environmentally friendly option for treating contaminated waterway sediments. Waterways include lakes, streams, rivers, flowages, reservoirs, and alternative open water sources. Embodiments of the present invention can be used in any water body, and particularly relatively shallow waterways where thin layer capping is required.

System 10 reduces costs relative to previously known capping methods by allowing rapid placement of capping material over large areas. In addition, various embodiments of the present invention allow tighter capping tolerances, which reduce the amount of capping material needed. This capping process allows for broadcast placement of sands and/or gravels for the purpose of in situ capping of contaminated sediments.

Figure 4:
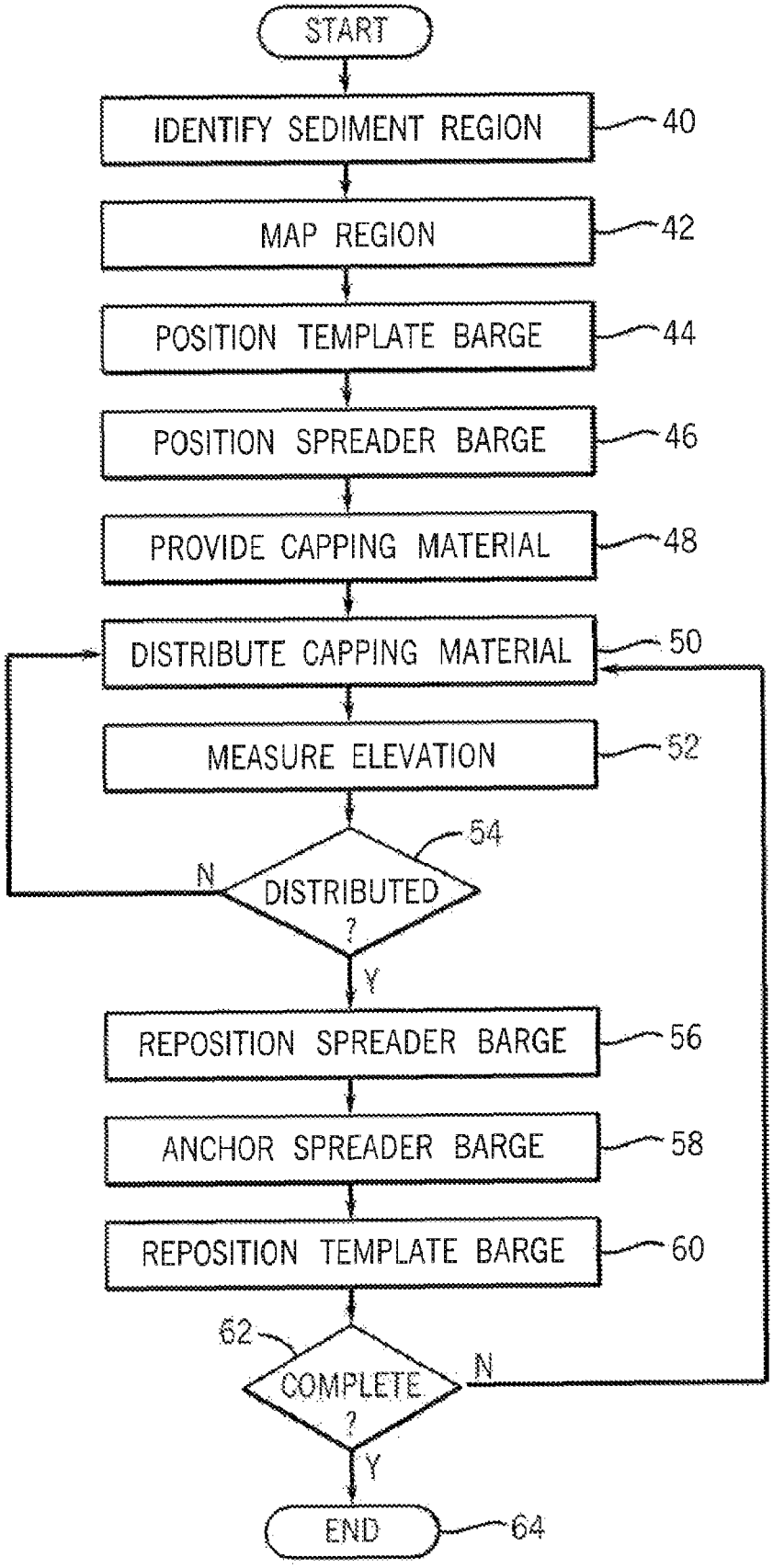
FIG. 4 is a block diagram representing a process for sub-aquatic capping in accordance with at least one embodiment of the present invention.

FIG. 4 is a block diagram representing a plurality of steps in the sediment capping process. A contaminated sediment region is identified at step 40 and the region is mapped at step 42. Mapping step 42 includes identification of various capping variables, including the type of capping material to be employed, the distribution rate of the capping material, the size of distribution pool 28, spreader barge 12 and template barge 14 movement sequence. After the region has been mapped, template barge 14 is positioned 44 at a distribution sequence starting position. Spreader barge 12 is then positioned 46 along side the template barge. At step 48, the capping material is provided to spreader barge 12 and the capping material is distributed within pool 28 at step 50. While the capping material is being distributed, the metering hopper and belt scale measure the weight of capping material distributed in real time. The weight measurements are compared to the predetermined capping material distribution amounts. As part of the verification process the sub-aquatic elevation of the capping material is measured at step 52. This can be performed through manual coring to verify the cap thickness. A distribution decision is made at step 54. If the proper amount of capping material was distributed, then the spreader barge changes its position at step 56. If an inadequate amount of capping material was distributed, then step 50 is repeated. The rate and sequence timing of the capping material distribution can be automatically altered based upon coring data. The size of barges 12, 14 and the size of pool 28 can determine the number of spreader barge 12 repositioning steps prior to repositioning of template barge 14. A repositioning sequence includes the initial positioning of template barge 14 and subsequent step-like repositioning of spreader barge 12. By example, the time for each spreader barge 14 "step" is in a range of about 2 minutes to about 5 minutes. The "step" time is dependant upon the production rate and the cap depth. The capping material is distributed during each spreader barge 12 step. In an alternative example, the spreader barge step is less than about 2 minutes or greater than about 5 minutes. After a set number of spreader barge 12 steps 56, spreader barge 12 is positioned at step 58. Template barge 14 is then repositioned at step 60. Step 62 determines whether the capping process is complete. If more capping is required, then step 50 is repeated; otherwise the process is completed at step 64.

Once the capping material is transported across the water body, via transportation barge, pipeline, or alternative means, it then enters spreader barge 14. Barges 12 and 14 work in unison by walking on spuds 30 in a linear path parallel to one another. Spreader barge 12, by example, is about 40 feet wide by about 80 feet long. Template barge 14, by example, is about 20 feet wide and about 120 feet long. Both barges 12 and 14 have spuds 30, which include hydraulic power-packs and winches. Except during initial placement, and movement to an alternative capping area, at least one of barges 12 and 14 is positioned and securely placed at all times. Alternatively, barges 12 and 14 can both be moved based upon elevation data or severe weather. When spreader barge 12 is moving, template barge 14 will have at least one spud 30 down which will hold barge 12 in place. Spreader barge 12 moves along the template barge 14 at a predetermined even rate until reaching its stopping point. At this time, spreader barge 12 is positioned and the template barge will step back. During these steps, distribution of the material is continuous, except when a complete change in the capping location occurs. Alternatively, spreader barge 12 is stationary for a predetermined time during which the capping material is distributed, after which it will be repositioned and re-commence distribution. The thickness of the capping layer can range from about 1½ inches to about 9 inches, the thickness being dependent upon the sediment being capped and the capping material. Alternatively, the capping layer thickness can be less than 1½ inches or greater than 9 inches.

Figure 5:
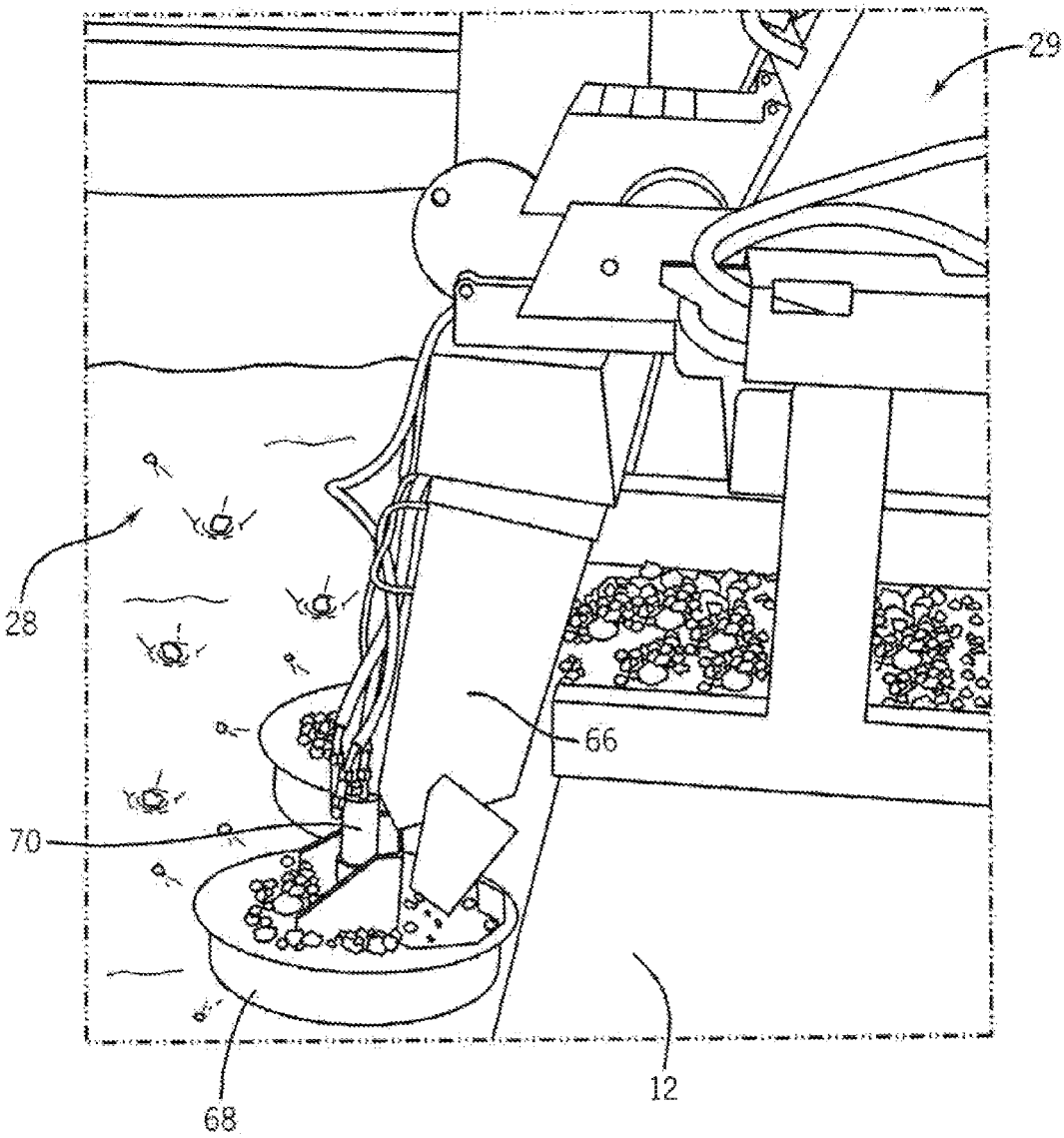
FIG. 5 is a side perspective view of the spreading means in accordance with at least one embodiment of the present invention.
Figure 6:
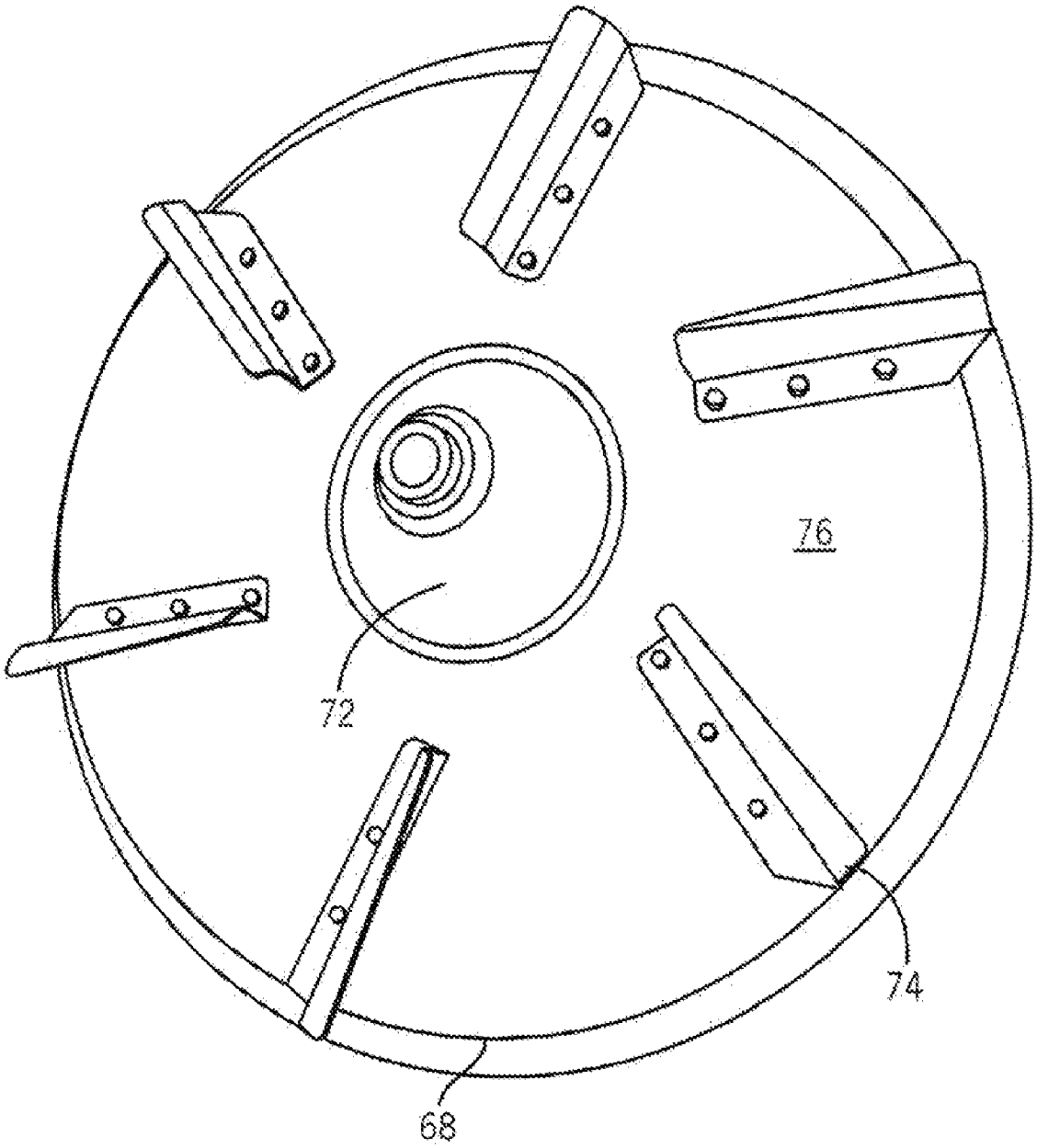
FIG. 6 is a perspective view of a capping material distribution spinner in accordance with at least one embodiment of the present invention.

Now referring to FIGS. 5 and 6, the spreading means 24 has a distribution chute 66 connected to the reservoir 29, a broadcast spinner 68, and an actuator 70. Capping material flows from the reservoir 29 and through the chute 66. After traveling down the chute 66 the capping material reaches the spinner 68 and is thereby broadcast into the pool 28. The spinner 68 is substantially disc-shaped and comprises an axis connector 72 and a plurality of distribution fins 74. The axis connector 72 has an aperture extending through it, which is mounted to the chute 66. The actuator 70 is a hydraulic system which causes the spinner 68 to spin. As capping material reaches the spinning spinner 68, the fins 74 act on the material to centripetally distribute the capping material within pool 28. The fins 74 extend radially outward from connector 72 and extend outward and substantially perpendicular to a spinner surface 76. As shown in FIG. 6, an exemplary spinner 68 includes six fins 72. In an alternative embodiment, the spinner 68 has one or more fins 74.

Alternatively, more than one spreading means 24 is connected to the reservoir 29. By example, two distribution means 24 can simultaneously distribute capping material into pool 28. The spinners 68 for the respective distribution means 24 are configured to spin in opposite directions, on spinning in a clockwise direction and the second spinning in a counter clockwise direction. Preferably the spinner 68 rotating in a clockwise direction is positioned to the right of the second spinner 68, which provides for a greater distribution area within pool 28. In at least one embodiment, the spreading means 24 includes a barge metering hopper and belt scale (not shown) for measuring the distributed capping material, and at least one spinner 68 to distribute the capping material into the pool 28. It is further contemplated that the size and shape of the spinners are selected based upon the capping material and desired rate of distribution.

Upon entering receiving means 18, the capping material passes through shaker 20, which includes a vibrating dewatering screen. In one embodiment, shaker 20 is capable of de-watering the slurry in excess of 200 tons per hour, based upon a screen measuring about 6 feet wide by about 16 feet long. Once the slurried capping material is dewatered, the clean transport water will be discharged overboard within pool 28. The capping material rolls off the end of the screen into distribution means 24. One exemplary distribution means 24 is an Epoke Sirius® (Epoke Inc., Stittsville, Ontario, Calif.) 6.5 cubic yard spreader. Alternatively, the distribution system includes a conveyor with a belt scale and a J.F. Brennan Co. hardened metal spreader. Spreader 24 is located on the bow of the spreader barge, broadcasting the de-watered capping material in a uniform pattern. Individual capping material particles will hit the water and fall through the water column at a reduced velocity, relative to bucket dumping, thereby covering the soft sediment with minimal disturbance. Alternately, granular capping material transported by barge can be offloaded by bucket and fed into the barge metering hopper for delivery to spreader 24.

In an alternative embodiment, spreader pool 28 is about 35 feet long by about 12 feet wide. Spreader pool 28 is an area of open water surrounded by barriers, that allow capping material to be placed into a confined area. The barriers are preferably wall-like structures that extend above the barge 12 surface in a range of about 2 feet to about 5 feet high. By example, the barriers can be constructed of plywood, cement, or durable fabric. By confining the distribution of capping material, turbidity issues are minimized, which in turn reduces agitation of the contaminated sediment. Spreader 24 broadcasts capping material into spreader pool 28 over a measured duration after which the spreader barge is winched back a specific distance alongside template barge 14. By example, the distribution rate can range from about 40 to about 60 cubic yards per hour and include 6-foot spreader barge 12 steps. Alternatively, spreader barge 12 can move continuously. In yet another alternative embodiment, the distribution rate can range from about 60 to about 100 cubic yards per hour. In yet another alternative embodiment, the distribution rate is less than 40 cubic yards per hour.

Capping material volume is measured to ensure accurate placement. A primary volume measurement is determined by the spreading means 24, which includes a belt scale that provides real time capping distribution weights. The size and speed of the conveyor can determine the amount of material sent to spreader 24. Once the required volume of capping material is placed, a signal is sent from the spreader unit to an alarm which sounds, alerting the plant operators that it is time to slide the spreader barge back another 6 feet. This system provides a continuous real time measurement of the volume of material being placed. Capping material volume can be metered onshore by conveyor 36 before being fed into slurry pipeline 16. Compared to spreader barge spreader 24, conveyor 36 metering will be used to determine volume measurements over longer periods of time, such as per day or on a weekly basis.

Both pre- and post-placement bathymetric surveys can be performed at the placement areas. The bathymetric vessel is designed for operations in shallow water. The vessel can be equipped with a single frequency fathometer, two real-time kinematic (RTK) Global positioning units, and one laptop computer unit. Post placement bathymetric surveys can be conducted within twenty-four to forty-eight hours after the barge places material over an area for quality control and confirmation of proper capping material distribution.

Control center 26 includes a computer which can utilize a variety of sub-aquatic analysis and measuring software. By example, the control center includes Dredgepack® (Hypack, Inc., Middletown, Conn.) software and Wonderware® (Invensys Systems, Inc., Lake Forest, Calif.) software. Dredgepack® can be used for positioning the spreader barge 12, while Wonderware® can track the production of capping material distribution data collected. Wonderware® can integrate the use of a plurality, four by example, of sounding sensors located in each corner of the spreader pool. The sensors provide RTK GPS for real time measurement of the materials elevation and the targeted elevation and location. Dredgepack® can provide illustrated pre-cover placement elevation in two profile views, along with a top view. As the material is added to the waterway floor, the sensors will measure and record the elevation of the placed material. The operator will visually see this elevation change in both profile views and the top view will display the change. In addition to tracking capping progress on a daily basis, each placement area can be divided into capping units. The capping units can be designated to assist the management of large sediment capping operations. Alternatively, the spreader 24 utilizes a Real Time Kinematic (RTK) Global Positioning System (GPS) for capping material position and elevation tracking. The RTK GPS system uses satellite links to two spreader barge mounted receivers, a fixed location receiver with known coordinates, and a geometric method, referred to as tri-lateration, to determine the real-time position and elevation of a point on the spreader 24 to within 4 centimeters. This reference point is configured at the capping material discharge location. As the spreader barge 12 travels, turns, and rises and falls on the lake, the system continually updates the northing and casting coordinates, heading, and elevation of the capping material discharge position. The coordinates of the spreader 24 are sent to a survey software system such as DredgePack. This software system can provide a continuous log of coordinates and elevations for the capping material discharge location and can provide tools to help the operator accurately locate the spreader barge 12 at required coordinates. For each sand spreading location, Intouch® software system inserts capping material spreading information into a Microsoft SQL Server database. The capping material spreading information stored in the database includes the time and date, position coordinates, actual sand tonnage spread, sand density, spreading time duration, etc. for that spreading step. All of this information is available to be viewed via an Internet web browser in the form of a pre-developed report.

Figure 7A:
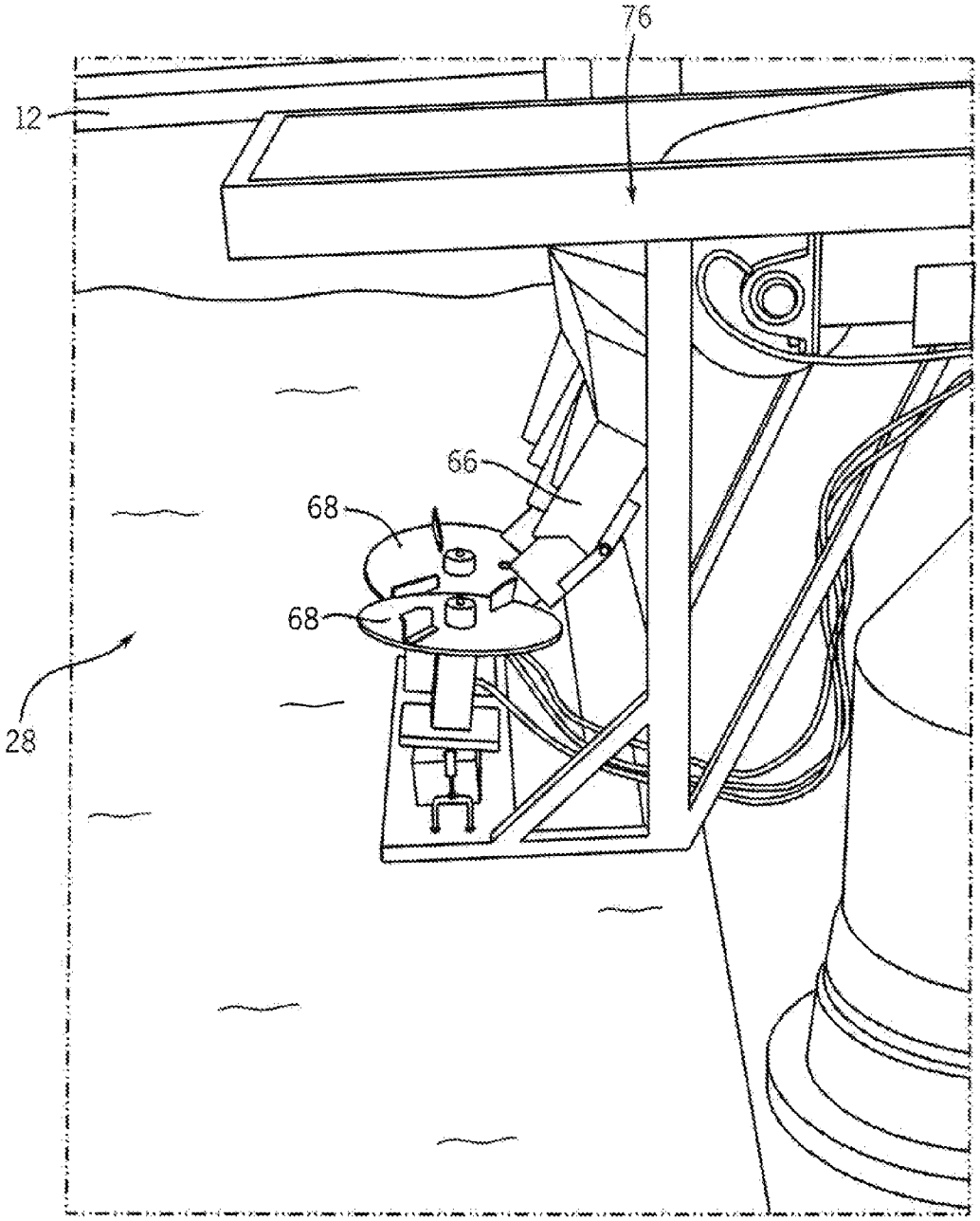
FIG. 7A is a perspective view of the spreading means in accordance with an alternative embodiment of the present invention.
Figure 7B:
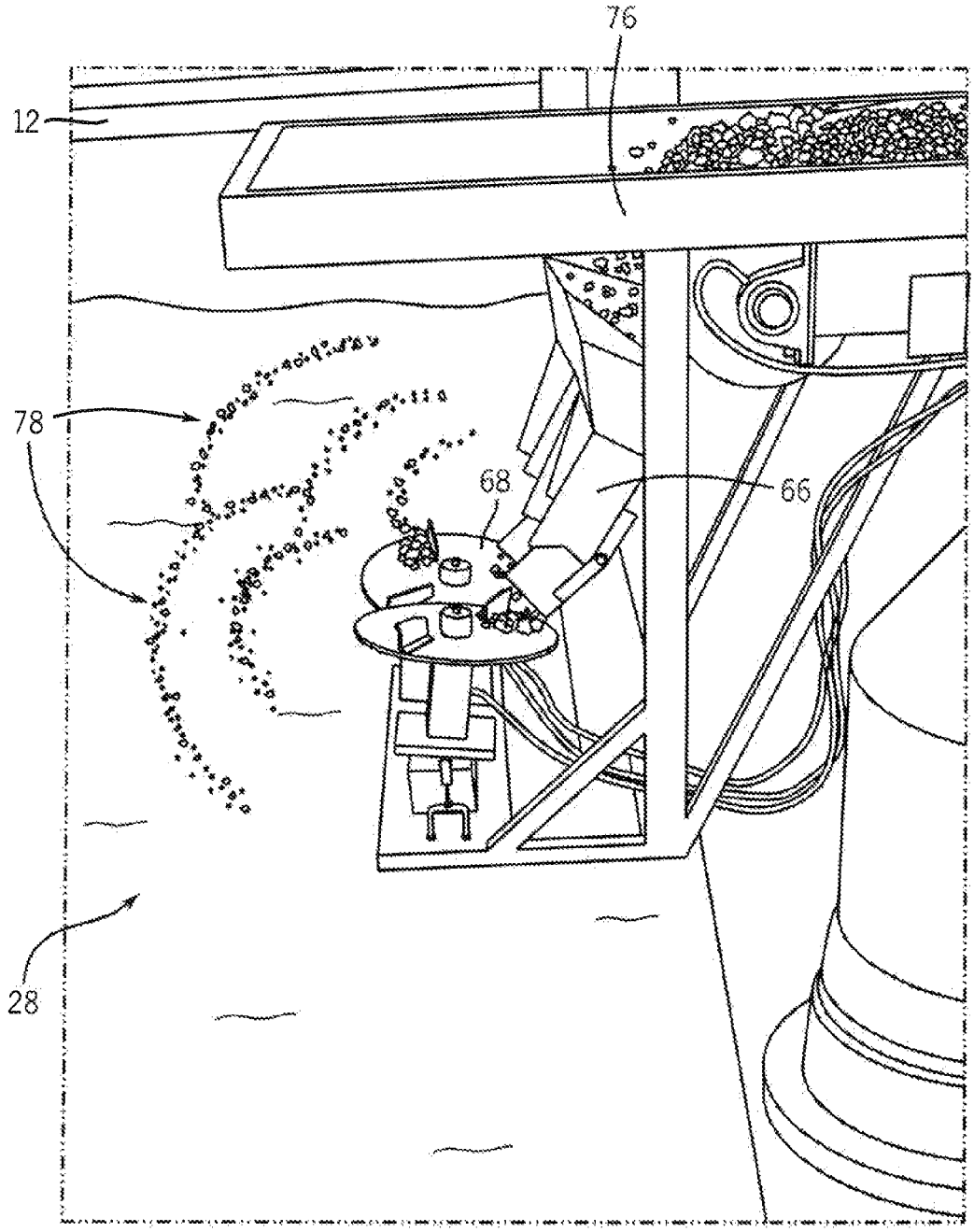
FIG. 7B is a perspective view of the spreading means of FIG. 7A in use and depicting a spreading pattern, in accordance with an alternative embodiment of the present invention.

Now referring to FIGS. 7A and 7B, an alternative embodiment of spreader 24 is shown. Two spinners 68 are suspended above pool 28 by a spreader frame 76. Chute 66 provides capping material to the spinners 68, which rotate and distribute the material within pool 28 in a semi-circular pattern 78 (See FIG. 7B). Each spinner 68 has a substantially flat top surface 80 which receives the capping material immediately prior to the capping material being distributed through centripetal forces. Spinners 68 are tilted toward each other, such that surface 68 is not parallel with pool 28. The orientation of spinners 68 can be altered to affect the distribution pattern 78. Orientation of spinners 68 can range from a substantially flat orientation to greater than 20 degrees pitch in any direction.

Figure 8:
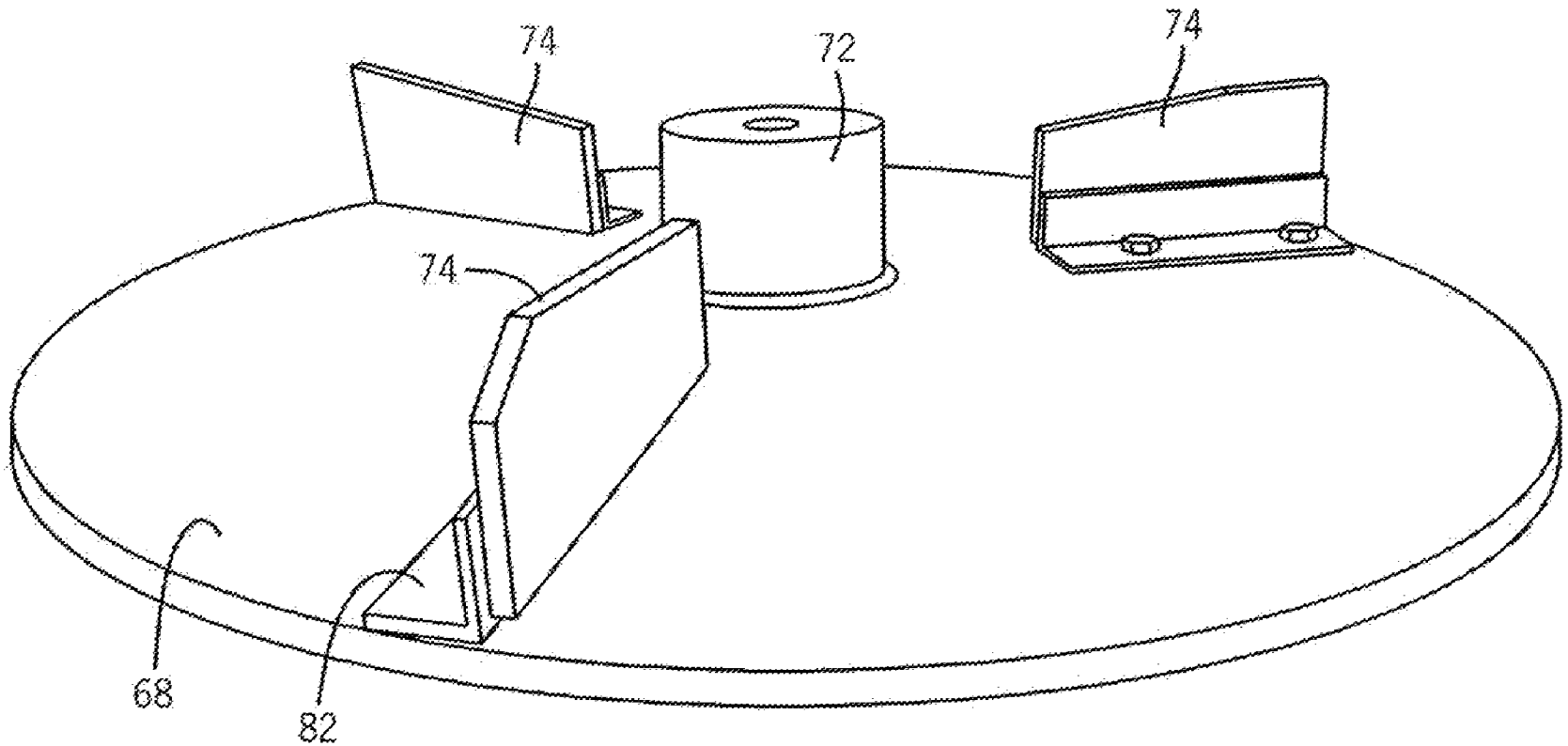
FIG. 8 is a perspective view of a capping material distribution spinner in accordance with an alternative embodiment of the present invention.

An alternative embodiment of spinner 68 is shown in FIG. 8. Spinner 68 includes three fins 74, an axis connector 72, and a substantially flat top surface 80. Each fin 74 is attached to surface 80 through an L-bracket 82. Any suitable connection means known in the art, such as welding, can be used to connect surface 80 to L-bracket 82, and fins 74 to L-bracket 82. Spinner 68 can be manufactured from a variety of durable materials known in the art, including low-cost metals and metal alloys. Alternatively, fins 74 can be manufactured from higher-cost materials having greater durability, such as composites, precious and semi-precious metals, and metal alloys. By example, surface 80 can be manufactured from 420 stainless steel, while the fins are manufactured from titanium alloys.

Although the invention has been described in considerable detail, within the preceding specification and figures, the detail is for the purpose of illustration only, and not to be limited to the embodiments and illustrations previously described. Those skilled in the art will recognize that many variations and modifications can be made to the invention without departing from the spirit and scope as described by the following claims.

The invention claimed is:

1. A sediment capping system comprising:

a spreader barge comprising (i) a capping material spreading means, (ii) a spreader pool, and (iii) a positioning means, the spreading means configured to distribute capping material into the spreader pool; and a template barge for guiding the spreader barge while the capping material is distributed to a sub-aquatic sediment, the template barge comprising a positioning means; and a capping material providing means, and an intake means for receiving the capping material.

2. The system according to claim 1 further comprising a real time kinematic (RTK) global positioning system (GPS) comprising:

a series of sensors for measuring and recording elevation of the distributed capping material; and a computer for processing sediment and capping material elevation data.

3. The system according to claim 1 further comprising a means for post placement quality control bathymetric surveys for analyzing the placement of granular capping material.

4. The system according to claim 1 wherein the intake means for the capping material is a slurry pipeline.

5. The system according to claim 1 wherein the capping material is selected from a group consisting of sand, gravel, chipped stone, rocks, pebbles, solid particulate matter and solid granular matter.

6. The system according to claim 1 further comprising a capping material shaker for separating capping material from a slurry.

7. The system according to claim 1 wherein the spreading means comprises a broadcast spinner.

8. A sediment capping system comprising:

a spreader barge for distributing a capping material over a contaminated sub-aquatic sediment;

a template barge configured to guide the movement of the spreader barge during distribution of the capping material; and a sub-aquatic elevation measuring means for acquiring real-time elevation data.

9. The system according to claim 8 further comprising a broadcast spreader for distributing capping material.

10. The system according to claim 9 wherein the spreader barge further comprises a spreader pool for distribution of capping material.

11. The system according to claim 10 wherein the spreader barge further comprises a receiving means for receiving a slurry, a shaker for dewatering the slurry, and a reservoir for storing capping material harvested from the slurry.

12. The system according to claim 10 wherein the broadcast spreader includes a spinner having a plurality of fins.

13. A method for capping a sub-aquatic sediment, the method comprising:

identifying a sub-aquatic sediment region for distributing a layer of capping material;

providing a source of capping material to a capping system comprising, the system comprising a template barge, a spreader barge, and a broadcast spreader device positioned on the spreader barge;

positioning the spreader barge and the template barge proximal to the sub-aquatic region;

distributing the capping material to form a sub-aquatic sediment cap; and initiating movement of the spreader barge in response to the distribution of a pre-determined amount of capping material.

14. The method according to claim 13 further comprising the step of mapping the sub-aquatic sediment region prior to the placement of the spreader barge over the sub-aquatic sediment region.

15. The method according to claim 13 further comprising the step of determining a capping material distribution rate based upon contaminated sub-aquatic sediment.

16. The method according to claim 14 wherein the capping material is provided to the spreader barge in the form of a slurry, the spreader barge comprising a de-watering means and a reservoir for storing the capping material.

17. The method according to claim 15 wherein at least two layers of capping material are distributed on top of the sediment.

18. The method according to claim 17 wherein at least one capping layer comprises sand and at least one capping layer comprises a non-granular material.

19. The system according to claim 18 wherein the spreader barge movement is based upon the capping material distribution rate.

20. The system according to claim 18 wherein the step of distributing the capping material is monitored using a Real Time Kinematic Global Positioning System.

* * * * *